US011903443B2

(12) United States Patent
Case et al.

(10) Patent No.: US 11,903,443 B2
(45) **Date of Patent: *Feb. 20, 2024**

(54) FOOTWEAR BLADDER SYSTEM

(71) Applicant: NIKE, Inc., Beaverton, OR (US)

(72) Inventors: Patrick Case, Portland, OR (US); Zachary M. Elder, Portland, OR (US); Dervin A. James, Hillsboro, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 198 days.

This patent is subject to a terminal disclaimer.

(21) Appl. No.: 17/529,467

(22) Filed: Nov. 18, 2021

(65) Prior Publication Data

US 2022/0071352 A1 Mar. 10, 2022

Related U.S. Application Data

(63) Continuation of application No. 16/671,810, filed on Nov. 1, 2019, now Pat. No. 11,213,094.

(60) Provisional application No. 62/769,852, filed on Nov. 20, 2018.

(51) Int. Cl.

| | |
|---|---|
| ***A43B 13/20*** | (2006.01) |
| ***A43B 21/28*** | (2006.01) |
| *A43B 13/02* | (2022.01) |
| *A43B 13/04* | (2006.01) |
| *A43B 13/12* | (2006.01) |
| *A43B 13/18* | (2006.01) |

(52) U.S. Cl.

CPC ..... *A43B 13/206* (2013.01); *A43B 13/20* (2013.01); *A43B 21/28* (2013.01); *A43B 13/023* (2013.01); *A43B 13/04* (2013.01); *A43B 13/12* (2013.01); *A43B 13/189* (2013.01)

(58) Field of Classification Search

CPC ..... A43B 13/20; A43B 13/203; A43B 13/206; A43B 13/023; A43B 13/04; A43B 13/12; A43B 13/189; A43B 21/28

See application file for complete search history.

(56) References Cited

U.S. PATENT DOCUMENTS

| | | | | |
|---|---|---|---|---|
| 3,300,880 A | | 1/1967 | Campagna | |
| 4,063,371 A | | 12/1977 | Batra | |
| 4,302,892 A | * | 12/1981 | Adamik | A43B 13/14 36/31 |
| 5,533,280 A | | 7/1996 | Halliday | |

(Continued)

FOREIGN PATENT DOCUMENTS

| | | |
|---|---|---|
| CN | 1133149 A | 10/1996 |
| CN | 1424881 A | 6/2003 |

(Continued)

*Primary Examiner* — Ted Kavanaugh
(74) *Attorney, Agent, or Firm* — Quinn IP Law

(57) ABSTRACT

A sole structure for an article of footwear includes a midsole with a bladder system having a forefoot region, a midfoot region, and a heel region. The bladder system defines a first sealed chamber retaining fluid as a first cushioning layer, the first sealed chamber extending over the forefoot region, the midfoot region, and the heel region. The bladder system further defines multiple discreet sealed chambers retaining fluid in isolation from one another, each of the multiple discreet chambers disposed at one side of the first sealed chamber, and fluidly isolated from the first sealed chamber.

15 Claims, 4 Drawing Sheets

(56) References Cited

U.S. PATENT DOCUMENTS

| | | | | |
|---|---|---|---|---|
| 5,987,780 | A * | 11/1999 | Lyden | A43B 13/206 36/35 B |
| 11,213,094 | B2 * | 1/2022 | Case | A43B 13/20 |
| 2001/0042321 | A1 * | 11/2001 | Tawney | A43B 13/20 36/43 |
| 2003/0183324 | A1 * | 10/2003 | Tawney | A43B 13/20 156/289 |
| 2004/0123495 | A1 * | 7/2004 | Greene | A43B 7/1425 36/31 |
| 2006/0156579 | A1 * | 7/2006 | Hoffer | A43B 13/186 36/28 |
| 2010/0325914 | A1 * | 12/2010 | Peyton | A43B 13/20 36/29 |
| 2012/0167413 | A1 | 7/2012 | Marvin et al. | |
| 2013/0167401 | A1 * | 7/2013 | Christensen | A43B 13/20 36/29 |
| 2013/0167402 | A1 * | 7/2013 | Christensen | A43B 13/184 36/29 |
| 2014/0283413 | A1 * | 9/2014 | Christensen | A43B 13/20 36/102 |
| 2014/0331517 | A1 | 11/2014 | Seo | |
| 2015/0082668 | A1 * | 3/2015 | Nonogawa | A43B 7/144 36/30 R |
| 2016/0073732 | A1 * | 3/2016 | Ernst | B29D 35/128 36/28 |
| 2018/0070675 | A1 * | 3/2018 | Campos, II | B29C 65/48 |

FOREIGN PATENT DOCUMENTS

| | | | |
|---|---|---|---|
| CN | 105682500 | A | 6/2016 |
| KR | 100741628 | B1 | 7/2007 |

* cited by examiner

FOOTWEAR BLADDER SYSTEM

CROSS-REFERENCE TO RELATED APPLICATION

This application is a continuation of U.S. application Ser. No. 16/671,810 filed on Nov. 1, 2019, which claims the benefit of priority to U.S. Provisional Application No. 62/769,852, filed Nov. 20, 2018, and both of which are hereby incorporated by reference in their entirety.

TECHNICAL FIELD

The present disclosure generally relates to a midsole for an article of footwear, and more specifically to a midsole with a bladder system.

BACKGROUND

An article of footwear typically includes a sole structure configured to be located under a wearer's foot to space the foot away from the ground. Sole structures in athletic footwear are typically configured to provide cushioning, motion control, and/or resilience.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
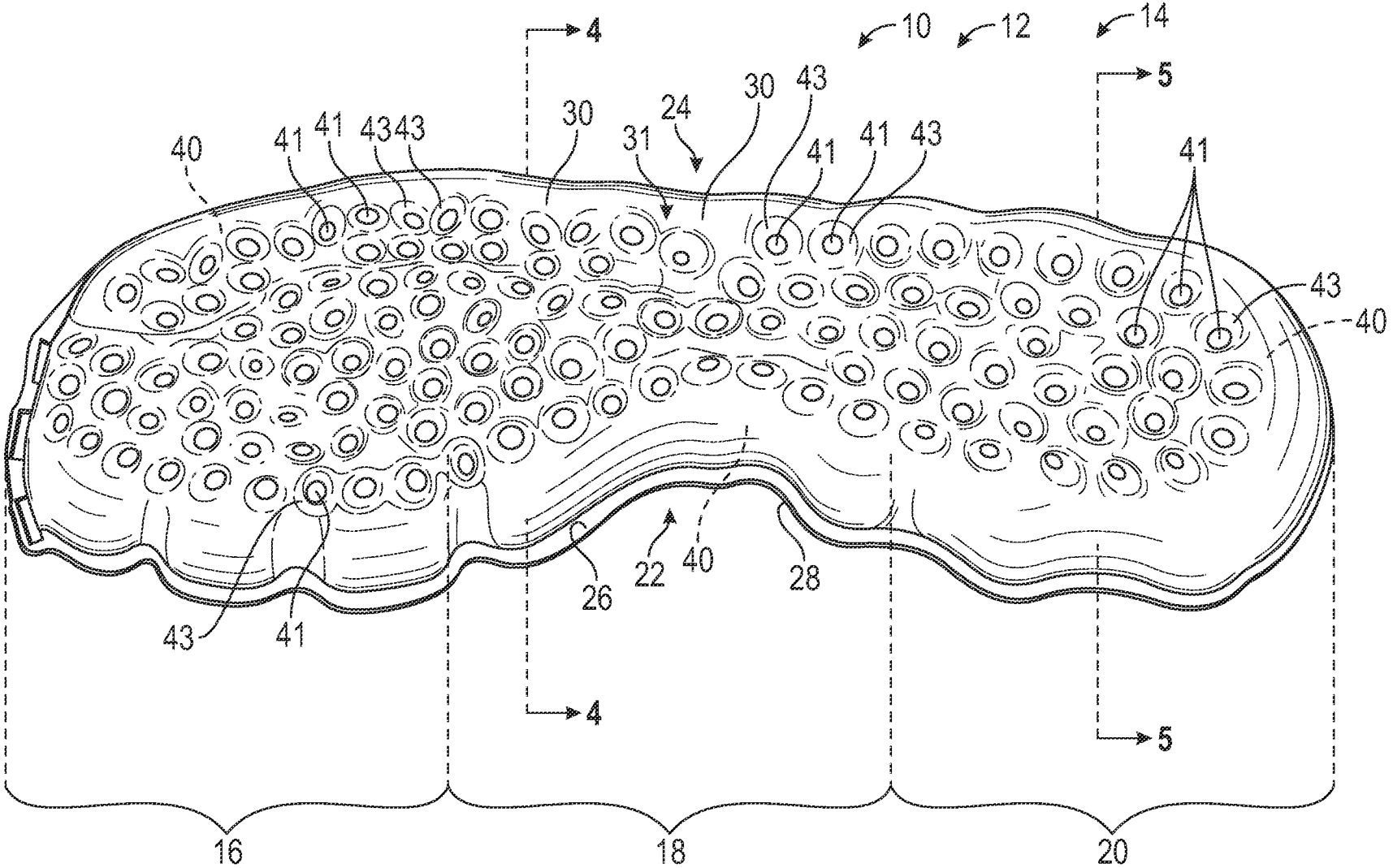
FIG. 1 is a top perspective view of a bladder system.

The present disclosure generally relates to a midsole for a footwear sole structure, and more specifically to a midsole with a bladder system providing a single fluid-filled chamber at a foot-facing surface, and multiple discreet fluid-filled chambers at a ground-facing surface. This enables the fluid-filled chamber at the foot-facing surface to be tuned for a specific uniform feel across the forefoot, midfoot, and heel regions, while the underlying discreet fluid-filled chambers may each be tuned in relation to the different loading experienced at their respective locations. The bladder system may comprise four stacked polymeric sheets. Bladders comprised of stacked polymeric sheets are generally easier to assemble and require less dedicated tooling. For example, thermoforming molds are not required. Instead, the geometry of the bladder system results mainly from the placement of anti-weld material between the stacked polymeric sheets before hot-pressing the sheets to one another. The placement of bonds securing the sheets to one another control the shape and geometry of the bladder system and its fluid chambers, as well as whether the fluid chambers are in communication with one another or isolated from one another, and the cushioning response of various portions of the bladder system.

In an example, a sole structure for an article of footwear comprises a midsole including a bladder system having a forefoot region, a midfoot region, and a heel region. The bladder system may define a first sealed chamber retaining fluid as a first cushioning layer, the first sealed chamber extending over the forefoot region, the midfoot region, and the heel region. The bladder system may further define multiple discreet sealed chambers retaining fluid in isolation from one another, each of the multiple discreet chambers disposed at one side of the first sealed chamber, and fluidly isolated from the first sealed chamber.

In one or more implementations, only the first sealed chamber and none of the multiple discreet sealed chambers extend in each of the forefoot region, the midfoot region, and the heel region. By providing the full-length first sealed chamber at the foot-facing surface however, a large, relatively flat surface area for attachment to the upper is provided, while the shape and pressure of the zonal discrete chambers at the ground-facing surface can be optimized for cushioning response.

In one or more configurations, the bladder system may define a foot-facing surface and a ground-facing surface. The first sealed chamber may be disposed between the foot-facing surface and the multiple discreet chambers. The multiple discreet chambers may be disposed between the ground-facing surface and the first sealed chamber.

In an aspect, the bladder system may include multiple stacked polymeric sheets including an upper sheet at least partially defining the foot-facing surface, a lower sheet at least partially defining the ground-facing surface, and a middle sheet disposed between the upper sheet and the lower sheet. The first sealed chamber may be enclosed by the upper sheet and the middle sheet. The bladder system may include an additional middle sheet as described herein, so that the bladder system includes four-stacked polymeric sheets. The multiple stacked polymeric sheets may be bonded together at a peripheral flange. For example, the multiple stacked polymeric sheets may be coextensive, each having an outer perimeter at the peripheral flange.

In a further aspect, the upper sheet may be bonded to the middle sheet at a plurality of dot bonds spaced apart from one another in the forefoot region, the midfoot region, and the heel region, with the first sealed chamber surrounding a perimeter of each of the dot bonds, and the foot-facing surface having a plurality of dimples at the plurality of dot bonds. In some embodiments, the first sealed chamber is the only fluid-filled chamber at the foot-facing surface.

In one or more implementations, the bladder system may comprise domed pods extending at the ground-facing surface, and the multiple discreet chambers may include a peripheral heel chamber in the heel region, a central heel chamber in the heel region, a peripheral lateral chamber in the forefoot region, and a medial forefoot chamber in the forefoot region. The peripheral heel chamber, the central heel chamber, the peripheral lateral chamber in the forefoot region, and the medial forefoot chamber in the forefoot region may include multiple fluidly-connected sub-chambers corresponding with the domed pods. In some embodiments, the peripheral heel chamber, the central heel chamber, the peripheral lateral chamber, and the medial forefoot chamber are the chambers at the ground-facing surface corresponding with the domed pods.

The isolation of the discreet sealed chambers at the ground-facing surface allows for different inflation pressures to effect different cushioning responses. In one or more configurations, an inflation pressure of gas retained in the peripheral lateral chamber may be greater than an inflation pressure of gas retained in the medial forefoot chamber. Moreover, the inflation pressure of gas retained in the peripheral lateral chamber may be greater than an inflation pressure of gas retained in the peripheral heel chamber, and greater than an inflation pressure of gas retained in the central heel chamber. In one example, an inflation pressure of gas retained in the peripheral lateral chamber may be greater than an inflation pressure of gas retained in the peripheral heel chamber, while the inflation pressure of gas retained in the peripheral heel chamber may be greater than an inflation pressure of gas retained in the central heel chamber, and the inflation pressure of gas retained in the central heel chamber may be greater than an inflation pressure of gas retained in the forefoot medial chamber. The first sealed chamber may have a greater or lesser inflation pressure than one or more of the underlying discreet sealed chambers. Some of the discreet chambers and/or the first sealed chamber may have the same inflation pressure, and at least some of the discreet chambers and/or the first sealed chamber may be at ambient pressure when in an unloaded state.

In an implementation, the bladder system may comprise multiple stacked polymeric sheets including a first sheet at least partially defining the foot-facing surface, a second sheet bonded to the first sheet, the first sealed chamber enclosed by the first sheet and the second sheet, a third sheet bonded to the second sheet, and a fourth sheet bonded to the third sheet and at least partially defining the ground-facing surface. At least one of the multiple discreet chambers may be enclosed by the second sheet and the third sheet, and at least one of the multiple discreet chambers may be enclosed by the third sheet and the fourth sheet. In some embodiments, the bladder system comprises only these four polymeric sheets and no other stacked polymeric sheets.

The bladder system may comprise domed pods extending at the ground-facing surface. The domed pods may be portions of the fourth (bottom) polymeric sheet. At least one of the multiple discreet chambers may include multiple fluidly-connected sub-chambers, the fluidly-connected sub-chambers corresponding with the domed pods. Stated differently, the shape of the fluidly-connected sub-chambers result in domed pods (e.g., rounded protrusions) at the ground-facing surface. Additionally, at least one of the multiple discreet chambers may include an annular ring portion that is fluidly isolated from and surrounds one of the sub-chambers corresponding with the domed pods. The annular ring portion may be at a lateral side of the forefoot region. In one example, one or more of the sub-chambers of the peripheral lateral chamber is surrounded by an annular ring portion of another one of the discreet chambers.

The multiple discreet chambers may include a peripheral heel chamber having an arcuate portion disposed at a rear of the heel region, a lateral arm portion extending forward from the arcuate portion along a lateral side of the bladder system in the heel region, and a medial arm portion extending forward from the arcuate portion along a medial side of the bladder system in the heel region, with the medial arm portion spaced apart from the lateral arm portion.

Additionally, the multiple discreet chambers may include a central heel chamber disposed between the medial arm portion and the lateral arm portion of the peripheral heel chamber, and forward of the arcuate portion of the peripheral heel chamber. The central heel chamber may include multiple fluidly-connected sub-chambers corresponding with multiple domed pods extending at the ground-facing surface of the bladder system. The multiple fluidly-connected sub-chambers of the central heel chamber and the domed pods that they correspond with may be disposed in a longitudinally-extending row between the lateral arm portion and the medial arm portion.

In one or more implementations, the multiple discreet chambers may include a peripheral lateral chamber extending along a lateral side of the bladder system in the forefoot region. The peripheral lateral chamber may be disposed entirely between a longitudinal midline of the bladder system and the lateral side of the bladder system. The bladder system may comprise domed pods extending at the ground-facing surface, and the peripheral lateral chamber may include multiple fluidly-connected sub-chambers corresponding with multiple ones of the domed pods disposed in a longitudinally-extending row along a lateral side of the ground-facing surface in the forefoot region. One of the multiple discreet chambers may include an annular ring portion that is fluidly isolated from and surrounds one of the sub-chambers of the peripheral lateral chamber. Additionally, the multiple discreet chambers may include a medial forefoot chamber disposed along a medial side of the bladder system in the forefoot region and extending over the longitudinal midline.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows a sole structure 10 for an article of footwear. Only a portion of the sole structure 10 is shown. More specifically, a midsole 12 of the sole structure 10 is shown. The midsole 12 includes a bladder system 14. The bladder system 14 shown is referred to as a full-length bladder system as it includes a forefoot region 16, a midfoot region 18, and a heel region 20. The midfoot region 18 is between the heel region 20 and the forefoot region 16. As is understood by those skilled in the art, the forefoot region 16 generally underlies the toes and metatarsal-phalangeal joints of an overlying foot. The midfoot region 18 generally underlies the arch region of the foot. The heel region 20 generally underlies the calcaneus bone. The bladder system 14 has a medial side 22 generally shaped to follow the medial side of an overlying foot, and a lateral side 24 generally shaped to follow the lateral side of an overlying foot.

Other components may be used in conjunction with the bladder system 14 to complete the midsole 12 and the sole structure 10. For example, in some embodiments, other components of the sole structure 10 may be secured to the bladder system 14. For example, an outsole or outsole components may be secured at a ground-facing surface, or a foam midsole layer may be secured at the ground-facing surface. Additionally or as an alternative, a foam midsole layer may be secured at a foot-facing surface 31. For example, different foam midsole layers may be secured at both the foot-facing surface 31 and the ground-facing surface. Additionally, a footwear upper may be secured to the bladder system 14 at the foot-facing surface 31 and/or at side surfaces formed by the inflated top and bottom sheets at an outer perimeter 28 of the bladder system 14.

The bladder system 14 includes four stacked polymeric sheets bonded together at a peripheral flange 26 as described herein. The peripheral flange 26 may extend entirely around an outer perimeter 28 of the bladder system 14, and the four stacked polymeric sheets may be coextensive, each extending to the peripheral flange 26 and having an outer perimeter 28 at the peripheral flange 26.

Figure 4:
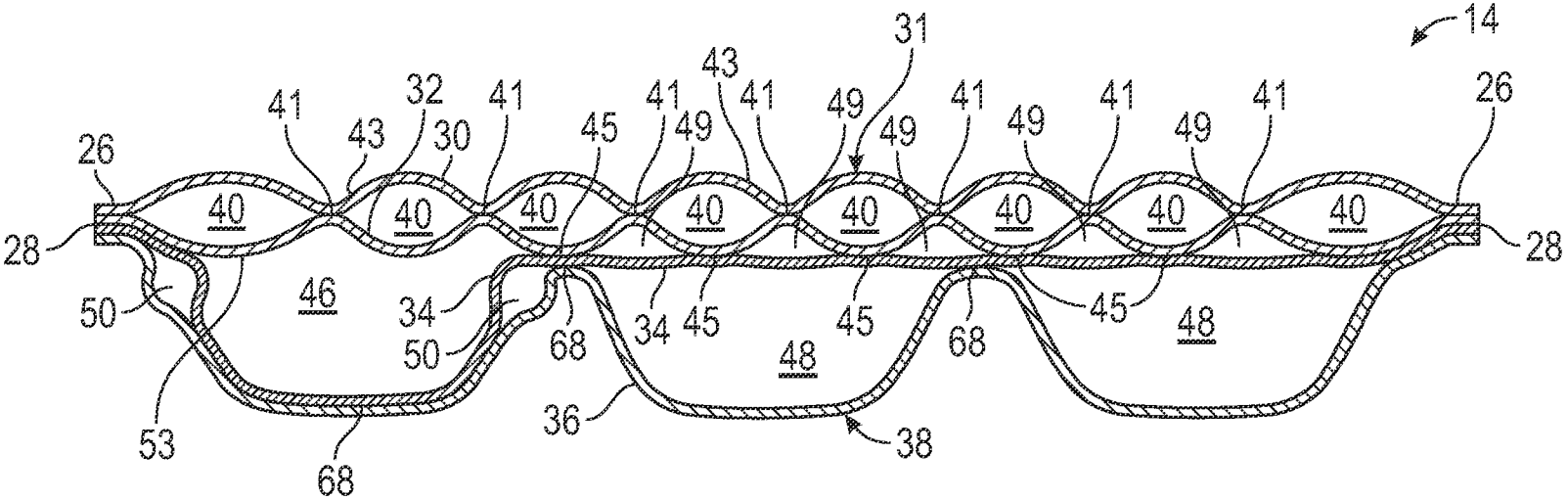
FIG. 4 is a cross-sectional view of the bladder system of FIG. 1 taken at lines 4-4 in FIG. 1.

Only a first sheet 30 is visible in FIG. 1. The first sheet 30 may also be referred to as an upper sheet. The upper sheet 30 includes and establishes a foot-facing surface 31 of the bladder system 14. The four stacked sheets are best shown in FIG. 4, which shows that the bladder system 14 also includes two middle sheets, referred to as a second sheet 32 and a third sheet 34, as well as a fourth sheet 36, referred to as a lower sheet or as a bottom sheet. The fourth sheet 36 includes and establishes a ground-facing surface 38 of the bladder system 14. A first sealed chamber 40 is enclosed by the first sheet 30 and the second sheet 32. The first sealed chamber 40 retains fluid as a first cushioning layer. The first sealed chamber 40 extends over the forefoot region 16, the midfoot region 18, and the heel region 20. The first sealed chamber 40 is the only sealed chamber of the bladder system 14 that is disposed at and defines the foot-facing surface 31. A foot supported on the bladder system 14 therefor has the first sealed chamber 40 underlying the expanse of the foot in each of the forefoot region 16, the midfoot region 18, and the heel region 20. The inflation pressure of the first sealed chamber 40 significantly impacts a wearer's perception of the stiffness of the bladder system 14 as the first sealed chamber 40 is closer to the foot than any of the other sealed chambers formed by the bladder system 14 and described herein.

The upper sheet 30 is bonded to the second sheet 32 at a plurality of dot bonds 41 spaced apart from one another in the forefoot region 16, the midfoot region 18, and the heel region 20. The dot bonds 41 are shown as small circles, but may be other closed shapes instead, such as a square or a triangle. The dot bonds 41 are evenly spaced apart from one another in rows. The dot bonds 41 in adjacent rows may be offset from one another. In FIG. 1, the evenly spaced pattern of the dot bonds 41 is somewhat obscured by slight waviness of the upper sheet 30 caused by the various inflation pressures of the underlying discrete chambers described herein. However, the dot bonds 41 are formed at evenly spaced circular areas not covered by blocker ink in a pattern of printed blocker ink applied to the bottom surface of the upper sheet 30 and a pattern of printed blocker ink applied to the upper surface of the second sheet 32. The foot-facing surface 31 also has a plurality of dimples 43 at the plurality of dot bonds 41. Each dot bond 41 causes the first sheet 30 to recess toward the dot bond 41, creating a dimple 43. A corresponding dimple is created in the second sheet 32 around where it is restrained at the bond 41. Only some of the dimples 43 and dot bonds 41 are indicated with reference numbers in FIG. 1. The dot bonds 41 act to limit the overall distance between the sheets 30, 32 when the first sealed chamber 40 is inflated, limiting the height of the first sealed chamber 40. The first sealed chamber 40 surrounds each of the dot bonds 41 between the first sheet 30 and the second sheet 32, and communicates around the bonds 41. During a forward foot roll in which dynamic loading begins at the heel region 20 and moves forward, gas in the first sealed chamber 40 is more easily displaced from rear to front, freely moving in the first sealed chamber 40 around the bonds 41. The cushioning response of the bladder system 14 is therefore staged not only in relation to absorption of a vertical impact force by the bladder system 14 by sealed chambers working in stages as described herein, but also in relation to the forward roll of the foot from heel to toe.

Figure 2:
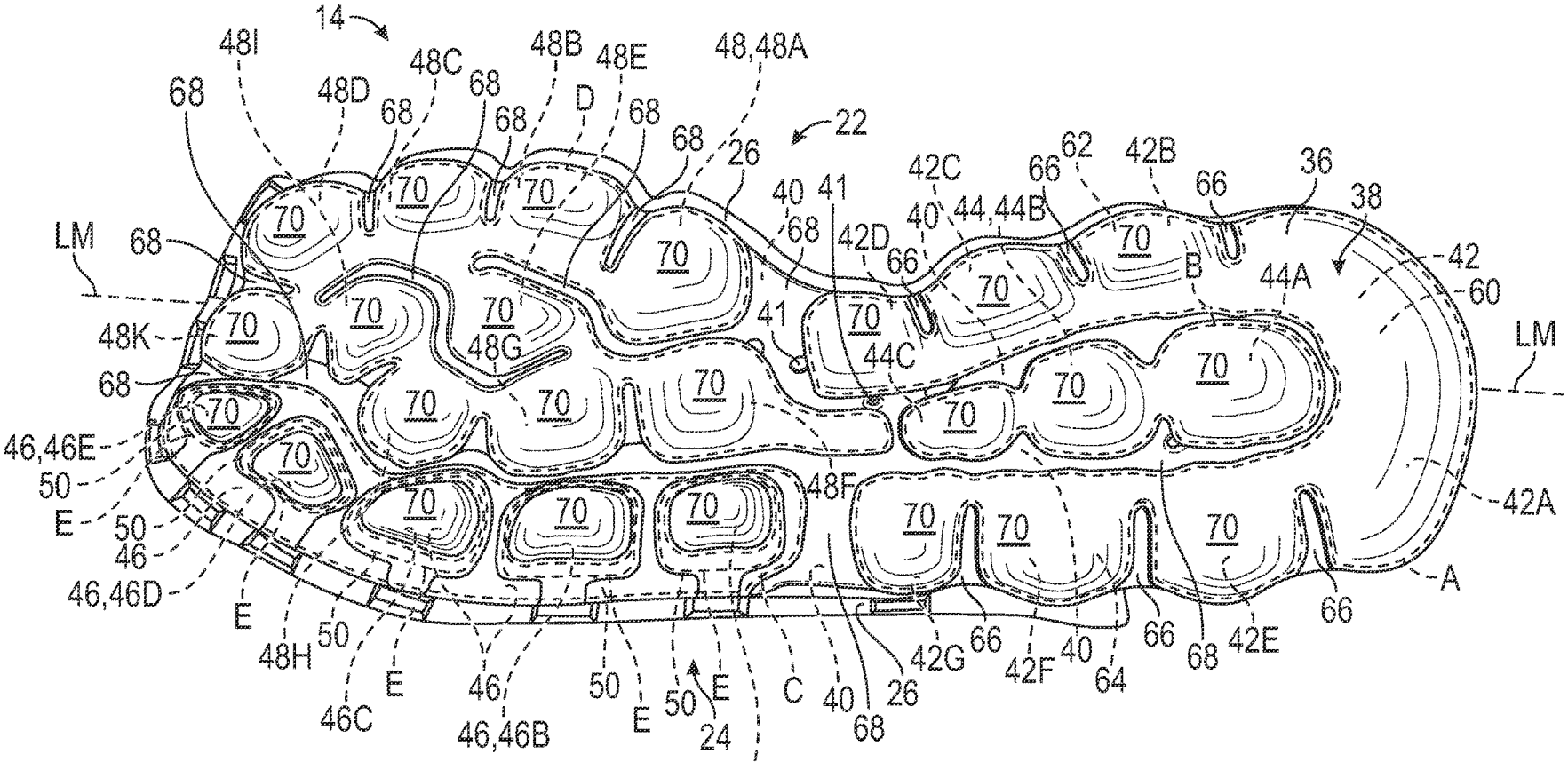
FIG. 2 is a bottom perspective view of the bladder system of FIG. 1.
Figure 5:
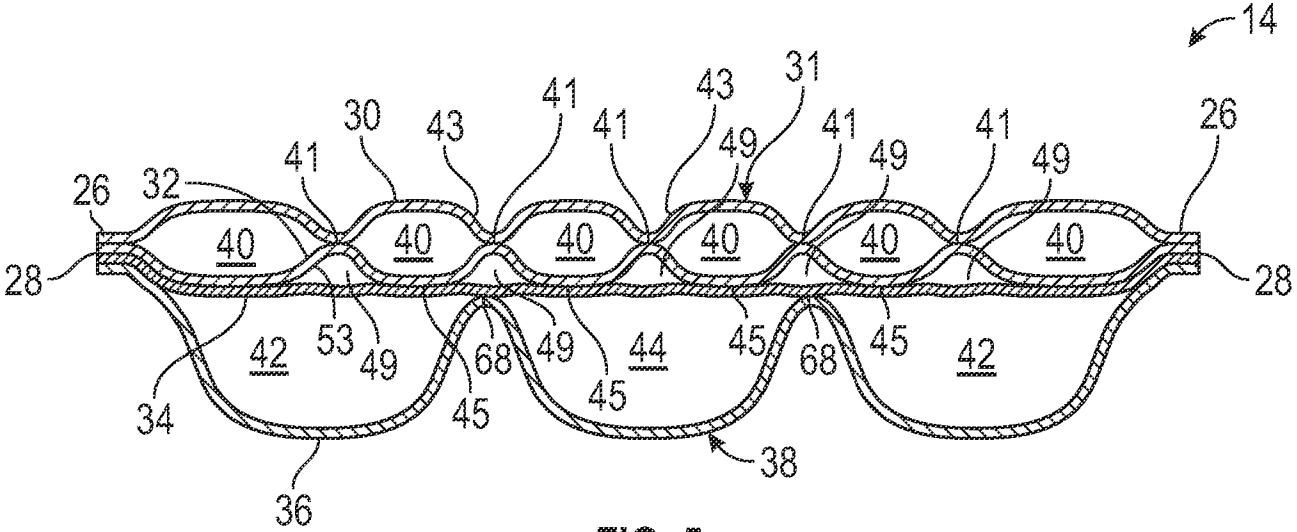
FIG. 5 is a cross-sectional view of the bladder system of FIG. 1 taken at lines 5-5 in FIG. 1.

FIGS. 4 and 5 show that multiple discreet chambers 42, 44, 46, 48, 49 and 50 are disposed on a first side 53 of the first sealed chamber 40, between the ground-facing surface 38 and the first sealed chamber 40. Accordingly, the first sealed chamber 40 is disposed between the foot-facing surface 31 and the multiple discreet chambers 42, 44, 46, 48, 49 and 50. With reference to FIG. 2, multiple discreet chambers 42, 44, 48 and 50 are enclosed between and bounded by the third sheet 34 and the fourth sheet 36. These chambers are fluidly isolated from one another by bonds 68 of the third sheet 34 to the fourth sheet 36 that separate the chambers. Two additional discreet chambers 46 and 49 are disposed between the second sheet 32 and the third sheet 34. The chambers 46 and 49 are isolated from one another by bonds 45 of the second sheet 32 to the third sheet 34.

The multiple discreet sealed chambers 42, 44, 46, 48, 49 and 50 retain fluid in isolation from one another, and each is also fluidly isolated from the first sealed chamber 40. The multiple discreet chambers include a peripheral heel chamber 42 in the heel region 20, a central heel chamber 44 in the heel region 20, a peripheral lateral chamber 46 in the forefoot region 16, and a medial forefoot chamber 48 in the forefoot region 16. Additionally, the discreet chamber 49 underlies the entire first sealed chamber 40 except where the peripheral lateral chamber 46 extends along the lateral side 24. The second sheet 32 may be bonded to the third sheet 34 at dot bonds 45, similar to dot bonds 41. The chamber 49 surrounds and is in fluid communication around the dot bonds 45.

Each of the discreet chambers 42, 44, 46, 48 and 50 is at least partially formed by the fourth sheet 36 and therefore is at the inner surface of the fourth sheet 36, and influences the shape of the ground-facing surface 38. An outer boundary of each of the discreet chambers 42, 44, 46, 48 and 50 is schematically represented with dashed lines in FIG. 2 to illustrate the fluid isolation of each of the chambers 42, 44, 46, 48 and 50. The boundary A is the boundary of the peripheral heel chamber 42. The boundary B is the boundary of the central heel chamber 44. The boundary C is the boundary of the peripheral lateral chamber 46. The boundary D is the boundary of the medial forefoot chamber 48. The ring-shaped boundaries E bound annular ring portions of a discreet chamber 50. The annular ring portions may be in fluid communication with one another by connecting channels, or may be fluidly isolated from one another by bonds of the third sheet 34 to the fourth sheet 36 between the annular portions.

The first sealed chamber 40 underlies the entire expanse shown in the bottom perspective view of FIG. 2, including underlying the discreet chambers 42, 44, 46, 48, 49 and 50 and each of the areas bounded by the dashed line boundaries A, B, C, D, and E in FIG. 2 (and overlies these same areas when the bladder system 14 is not inverted as it is in FIG. 2). The first sealed chamber 40 is indicated in FIG. 2 with reference lines in only some areas. Similarly, the discreet chamber 49 underlies the discreet chambers 42, 44, 48, and 49 and each of the areas bounded by the dashed line boundaries A, B, and D in FIG. 2 (and overlies these same areas when the bladder system 14 is not inverted as it is in FIG. 2), but is indicated in FIG. 2 with reference lines in only some areas Because the sheets 30, 32, 34, and 36 may be transparent, some of the dot bonds 41 are indicated in FIG. 2.

The bladder system 14 has protruding, domed pods 70 extending at the ground-facing surface 38 due to the shapes of the various sealed chambers, and sub-chambers within the sealed chambers. Each of the domed pods 70 is a portion of the fourth sheet 36 (e.g., the bottom sheet) where it forms a domed protrusion. For example, the peripheral heel chamber 42, the central heel chamber 44, the peripheral lateral chamber 46 in the forefoot region 16, and the medial forefoot chamber 48 in the forefoot region 16 each include multiple fluidly-connected sub-chambers corresponding with the domed pods.

The peripheral heel chamber 42 has an arcuate portion 60 disposed at a rear of the heel region 20, a lateral arm portion 64 extending forward from the arcuate portion 60 along the lateral side 24 of the bladder system 14 in the heel region 20, and a medial arm portion 62 extending forward from the arcuate portion 60 along the medial side 22 of the bladder system 14 in the heel region 20. The medial arm portion 62 is spaced apart from the lateral arm portion 64, and the central heel chamber 44 is disposed between the arm portions 62, 64, and forward of the arcuate portion 60 of the peripheral heel chamber 42.

The peripheral heel chamber 42 includes multiple fluidly-connected sub-chambers 42A, 42B, 42C, 42D, 42E, 42F, and 42G. Sub-chamber 42A is in the arcuate portion 60, sub-chambers 42B, 42C, and 42D are in the medial arm portion 62, and sub-chambers 42E, 42F, and 42G are in the lateral arm portion 64. Bonds 66 between the third sheet 34 and the fourth sheet 36 narrow the peripheral heel chamber 42, partially dividing it into the sub-chambers. However, the bonds 66 do not completely close the peripheral heel chamber 42 between adjacent sub-chambers, and all of the sub-chambers 42A, 42B, 42C, 42D, 42E, 42F, and 42G are in fluid communication with one another.

The central heel chamber 44 includes multiple fluidly-connected sub-chambers 44A, 44B, and 44C each corresponding with a domed pod 70 that extends at the ground-facing surface 38 of the bladder system 14. The multiple fluidly-connected sub-chambers 44A, 44B, and 44C and the domed pods 70 that they correspond with are disposed in a longitudinally-extending row between the medial arm portion 62 and the lateral arm portion 64. A bond 68 between the third sheet 34 and the fourth sheet 36 separates the peripheral heel chamber 42 from the central heel chamber 44, and partially divides it into the sub-chambers 44A, 44B, and 44C. However, the bond 68 does not completely close the central heel chamber 44 between adjacent ones of the sub-chambers 44A, 44B, and 44C, and all of the sub-chambers 44A, 44B, and 44C are in fluid communication with one another. Some other areas where the third sheet 34 is bonded to the fourth sheet 36 are shown with reference numeral 68 in FIG. 2, and may represent the same continuous bond 68 or different bonds 68 of the third sheet 34 to the fourth sheet 36.

The peripheral lateral chamber 46 extends along the lateral side 24 of the bladder system 14 in the forefoot region 16 and is disposed entirely between a longitudinal midline LM of the bladder system 14 and the lateral side 24 of the bladder system 14. The peripheral lateral chamber 46 includes multiple fluidly-connected sub-chambers 46A, 46B, 46C, 46D, and 46E corresponding with domed pods 70 disposed in a longitudinally-extending row along the lateral side 24 of the ground-facing surface 38 in the forefoot region 16. Rather than being separated by bonds, these sub-chambers 46A, 46B, 46C, 46D, and 46E are each disposed inward of and surrounded by a different one of the annular ring portions of the sub-chamber 50.

The medial forefoot chamber 48 is disposed along the medial side 22 of the bladder system 14 in the forefoot region 16 and extends over the longitudinal midline LM. The bonds 68 between the third sheet 34 and the fourth sheet 36 partially divide the medial forefoot chamber 48 into sub-chambers 48A, 48B, 48C, 48D, 48E, 48F, 48G, 48H, 48I, and 48K. Domed pods 70 correspond with the sub-chambers 48A, 48B, 48C, 48D, 48E, 48F, 48G, 48H, 48I, and 48K. However, the bond 68 does not completely close the medial forefoot chamber 48 between adjacent ones of the sub-chambers 48A, 48B, 48C, 48D, 48E, 48F, 48G, 48H, 48I, and 48K, and all of the sub-chambers 48A, 48B, 48C, 48D, 48E, 48F, 48G, 48H, 48I, and 48K are in fluid communication with one another.

As shown, there are six domed pods 70 at the peripheral heel chamber 42, three domed pods at the central heel chamber 44, five domed pods 70 at the peripheral lateral chamber 46, and ten domed pods 70 at the medial forefoot chamber 48. As is evident in FIG. 2, the domed pods 70 are not all of the same shape or size, and at least some of the domed pods 70 have different internal volumes. The different shapes and internal volumes of the domed pods 70 affect the cushioning provided during dynamic loading to the portions of the foot that they underlie.

The isolation of the discreet sealed chambers allows for different inflation pressures to effect different cushioning responses. For example, an inflation pressure of gas retained in the peripheral lateral chamber 46 may be greater than an inflation pressure of gas retained in the medial forefoot chamber 48. Moreover, the inflation pressure of gas retained in the peripheral lateral chamber 46 may also be greater than an inflation pressure of gas retained in the peripheral heel chamber 42, and greater than an inflation pressure of gas retained in the central heel chamber 44. In one example, an inflation pressure of gas retained in the peripheral lateral chamber 46 is greater than an inflation pressure of gas retained in the peripheral heel chamber 48, while the inflation pressure of gas retained in the peripheral heel chamber 48 is greater than an inflation pressure of gas retained in the central heel chamber 44, and the inflation pressure of gas retained in the central heel chamber 44 is greater than an inflation pressure of gas retained in the forefoot medial chamber 42. The first sealed chamber 40 may have a greater or lesser inflation pressure than one or more of the underlying sealed chambers 42, 44, 46, 48, 49, and 50, and the sealed chamber 49 may have a greater or lesser inflation pressure than one or more of the other sealed chambers 40, 42, 44, 46, 48, and 50. In other examples, different relative inflation pressures may be provided. Some of the discreet chambers may have the same inflation pressure, and/or at least some of the discreet chambers may be at ambient pressure when in an unloaded state.

Figure 3:
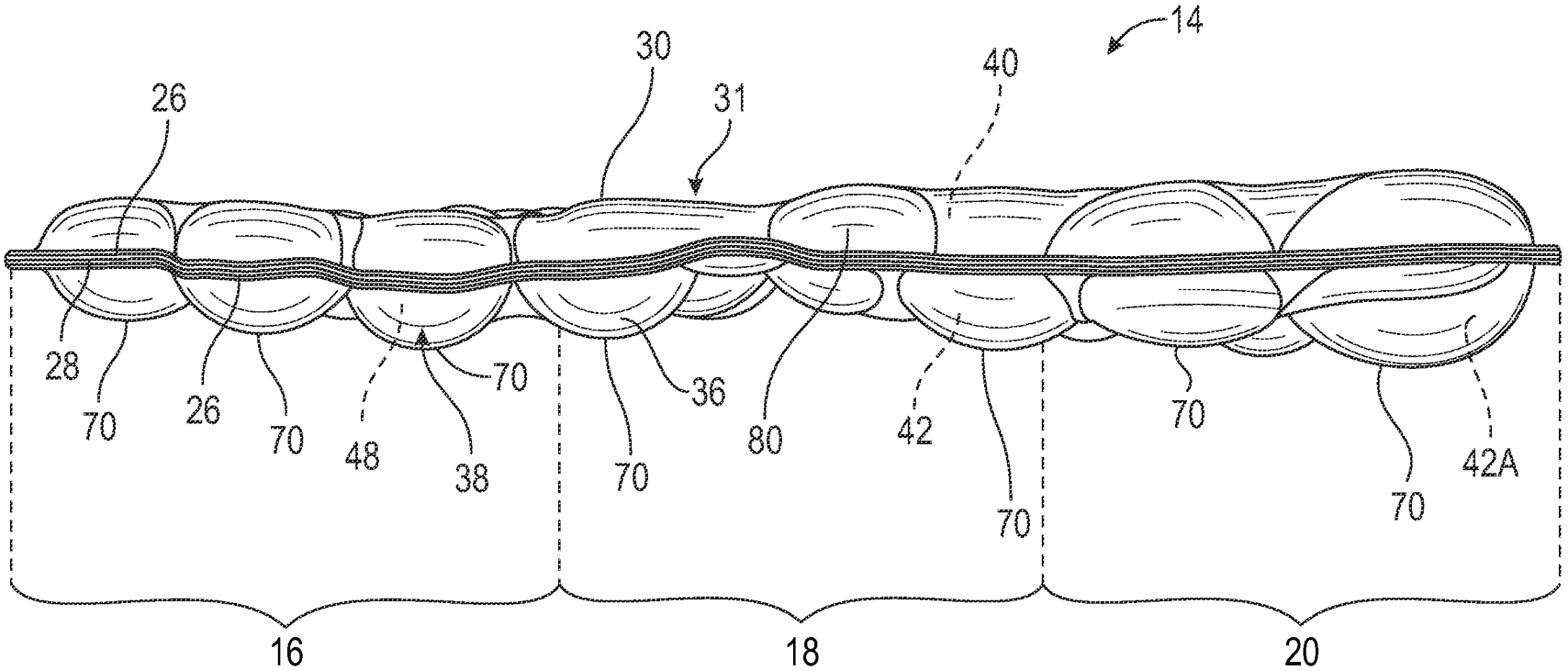
FIG. 3 is a medial side view of the bladder system of FIG. 1.

FIG. 3 is a medial side view of the bladder system 14 that illustrates some of the many domed pods 70 descending and protruding at the ground-facing surface 38, in contrast to the relatively flat foot-facing surface 31 provided due to the full-length sealed chamber 40 with a large number of small, spaced bonds 41 in a repeating pattern. There is an outer peripheral portion of the first sheet 30 to which the pattern of bonds 41 does not extend (e.g., the dot bonds 41 are somewhat inward of the peripheral flange 26). The outer peripheral portion without bonds 41 forms a portion of a side wall 80 when the chambers of the bladder system 14 are inflated, and the bonds 41 are not visible in the side view of FIG. 3.

FIG. 4 shows that the multiple stacked polymeric sheets 30, 32, 34, and 36 are coextensive, each having an outer perimeter 28 at the peripheral flange 26. Each of the polymeric sheets 30, 32, 34, and 36 extends from the forefoot region 16 to the heel region 20, and from the medial side 22 to the lateral side 24. Stated differently, there are only four polymeric sheets used to construct the bladder system 14, and each sheet extends the width and length of the bladder system 14.

The cross-sectional view of FIG. 4 shows that the first sealed chamber 40 is disposed between the foot-facing surface 31 and the multiple discreet chambers (only discrete chambers 46, 48, 49, and 50 visible in FIG. 4). Likewise, the multiple discreet chambers 46, 48, 49, and 50 are disposed between the ground-facing surface 38 and the first sealed chamber 40. The cross-sectional view of FIG. 5 shows that the first sealed chamber 40 is disposed between the foot-facing surface 31 and the discreet chambers 42, 44, and 49 (discreet chambers 46 and 48 not visible in FIG. 5). Different bonds between the stacked sheets are illustrated in FIGS. 4 and 5, including the dot bonds 41 bonding the first sheet 30 to the second sheet 32, the dot bonds 45 bonding the second sheet 32 to the third sheet 34, bonds 68 bonding the third sheet 34 to the fourth sheet 36, and bonds between adjacent ones of the stacked sheets 30, 32, 34, 36 at the peripheral flange 26. The dot bonds 41 are inward of the peripheral flange 26 and bond the lower surface of the first sheet 30 to the upper surface of the second sheet 32.

Selection of the shape, size, and location of the various bonds between the sheets 30, 32, 34, and 36 provides the desired contoured surfaces of the finished bladder system 14, including the domed pods 70 and the relatively flat foot-facing surface 31, and also provides or prevents fluid communication between different chambers of the bladder system 14. Prior to bonding, the polymeric sheets 30, 32, 34, and 36 are stacked, flat sheets that are coextensive with one another. Anti-weld material is applied to interfacing surfaces of the sheets 30, 32, 34, and 36 where bonds are not desired. For example, the anti-weld material may be referred to as blocker ink, and may be ink-jet printed according to a programmed pattern for each sheet 30, 32, 34, and 36 at all selected locations on the sheets where bonds between adjacent sheets are not desired. The stacked, flat polymeric sheets 30, 32, 34, and 36 are then heat pressed to create bonds between adjacent sheets on all adjacent sheet surfaces except for where the anti-weld material was applied. No thermoforming molds or radio frequency welding is necessary. In the completed bladder system 14, areas where the anti-weld material was applied will be at the internal volumes of the various sealed chambers 40, 42, 44, 46, 48, 49 and 50.

Once bonded, the polymeric sheets 30, 32, 34, and 36 remain flat, and take on the contoured shape of the bladder system 14 only when the chambers 40, 42, 44, 46, 48, 49 and 50 are inflated and then sealed. The polymeric sheets 30, 32, 34, and 36 are not thermoformed in a mold. Accordingly, if the inflation gas is removed, and assuming other components are not disposed in any of the sealed chambers, and the polymeric sheets 30, 32, 34, and 36 are not yet bonded to other components such as an outsole, other midsole layers, or an upper, the polymeric sheets 30, 32, 34, and 36 will return to their initial, flat state.

The polymeric sheets 30, 32, 34, and 36 can be formed from a variety of materials including various polymers that can resiliently retain a fluid such as air or another gas. Examples of polymer materials for the polymeric sheets 30, 32, 34, and 36 include thermoplastic urethane, polyurethane, polyester, polyester polyurethane, and polyether polyurethane. Moreover, the polymeric sheets 30, 32, 34, and 36 can each be formed of layers of different materials. In one embodiment, each polymeric sheet 30, 32, 34, and 36 is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet 30, 32, 34, and 36 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets 30, 32, 34, and 36 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets 30, 32, 34, and 36 are disclosed in U.S. Pat. Nos. 4,183,156 and 4,219,945 to Rudy which are incorporated by reference in their entireties. Further suitable materials for the polymeric sheets 30, 32, 34, and 36 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets 30, 32, 34, and 36, engineering properties such as tensile strength, stretch properties, fatigue characteristics, dynamic modulus, and loss tangent can be considered. The thicknesses of polymeric sheets 30, 32, 34, and 36 can be selected to provide these characteristics.

Because they are isolated from one another, the sealed chambers 40, 42, 44, 46, 48, 49 and 50 may be filled with gas at the same or at different inflation pressures to achieve a desired cushioning response. For example, the discreet sealed chambers 42, 44, 46, 48, 49, and/or 50 which are closer to the ground than the first sealed chamber 40 may have a lower inflation pressure than the first sealed chamber 40. Each sealed chamber 40, 42, 44, 46, 48, 49 and 50 retains gas at a predetermined pressure to which it is inflated when the bladder system 14 is in an unloaded state. The unloaded state is the state of the bladder system 14 when it is not under either steady state loading or dynamic loading. For example, the unloaded state is the state of the bladder system 14 when it is not bearing any loads, such as when it is not worn on a foot. A dynamic compressive load on the bladder system 14 is due to an impact of the sole structure 10 with the ground, and the corresponding footbed load of a person wearing the article of footwear having the bladder system 14 and an opposite ground load. The dynamic compressive load may be absorbed by the chambers of the bladder system 14 in a sequence according to increasing magnitudes of the stiffness from least stiff to most stiff, with higher inflation pressures associated with greater stiffness. Generally, a smaller volume chamber will reach a maximum displacement under a given dynamic load faster than a larger volume chamber of the same or lower inflation pressure, providing return energy faster than the larger volume chamber.

Stiffness of a cushioning layer such as a sealed fluid chamber is indicated by a plot of force versus displacement under dynamic loading, with stiffness being the ratio of change in compressive load (e.g., force in Newtons) to displacement of the cushioning layer (e.g., displacement in millimeters along the axis of the compressive load). The compressive stiffness of different portions of the bladder system 14 would be dependent in part upon the relative inflation pressures. Assuming the four stacked sheets 30, 32, 34, 36 are of the same material or materials and construction, and are of equal thickness, a chamber of equal volume and shape of another chamber but with a lower inflation pressure should experience greater initial displacement under dynamic loading, providing an initial stage of relatively low stiffness, followed by a subsequent stage of greater stiffness after reaching its maximum compression. The equal volume chamber of a greater inflation pressure or a lower volume chamber of equal inflation pressure should provide a steeper ramp in stiffness on a load versus displacement curve. Additionally, as the entire first sealed chamber 40 is in fluid communication from the heel region 20 to the forefoot region 16, and the entire sealed chamber 49 is likewise in fluid communication from the heel region 20 to the forefoot region 16, preloading of the midfoot region 18 and the forefoot region 16 will occur as the foot compresses the bladder system 14 with an initial heel strike and a roll forward, increasing the stiffness of the midfoot region 18, and then of the forefoot region 16 during the forward roll. This may beneficially provide a relatively stiff, supportive platform for toe off.

The following Clauses provide example configurations of an article of footwear disclosed herein.

Clause 1: A sole structure for an article of footwear comprising: a midsole including a bladder system having a forefoot region, a midfoot region, and a heel region wherein the bladder system defines: a first sealed chamber retaining fluid as a first cushioning layer, the first sealed chamber extending over the forefoot region, the midfoot region, and the heel region; and multiple discreet sealed chambers retaining fluid in isolation from one another, each of the multiple discreet chambers disposed at one side of the first sealed chamber, and fluidly isolated from the first sealed chamber.

Clause 2: The sole structure of Clause 1, wherein none of the multiple discreet chambers extend in each of the forefoot region, the midfoot region, and the heel region.

Clause 3: The sole structure of Clause 1, wherein: the bladder system defines a foot-facing surface and a ground-facing surface; the first sealed chamber is disposed between the foot-facing surface and the multiple discreet chambers; and the multiple discreet chambers are disposed between the ground-facing surface and the first sealed chamber.

Clause 4: The sole structure of Clause 3, wherein: the bladder system includes multiple stacked polymeric sheets including: an upper sheet at least partially defining the foot-facing surface, a lower sheet at least partially defining the ground-facing surface, and a middle sheet disposed between the upper sheet and the lower sheet; and the first sealed chamber is enclosed by the upper sheet and the middle sheet.

Clause 5: The sole structure of Clause 4, wherein the multiple stacked polymeric sheets are bonded together at a peripheral flange.

Clause 6: The sole structure of any of Clauses 4-5, wherein the upper sheet is bonded to the middle sheet at a plurality of dot bonds spaced apart from one another in the forefoot region, the midfoot region, and the heel region, the first sealed chamber surrounding a perimeter of each of the dot bonds, the foot-facing surface having a plurality of dimples at the plurality of dot bonds.

Clause 7: The sole structure of Clause 3, wherein: the bladder system comprises domed pods extending at the ground-facing surface; the multiple discreet chambers include: a peripheral heel chamber in the heel region, a central heel chamber in the heel region, a peripheral lateral chamber in the forefoot region, and a medial forefoot chamber in the forefoot region, and the peripheral heel chamber, the central heel chamber, the peripheral lateral chamber in the forefoot region, and the medial forefoot chamber in the forefoot region include multiple fluidly-connected sub-chambers corresponding with the domed pods.

Clause 8: The sole structure of Clause 7, wherein an inflation pressure of gas retained in the peripheral lateral chamber is greater than an inflation pressure of gas retained in the medial forefoot chamber.

Clause 9: The sole structure of Clause 8, wherein the inflation pressure of gas retained in the peripheral lateral chamber is greater than an inflation pressure of gas retained in the peripheral heel chamber, and greater than an inflation pressure of gas retained in the central heel chamber.

Clause 10: The sole structure of Clause 7, wherein: an inflation pressure of gas retained in the peripheral lateral chamber is greater than an inflation pressure of gas retained in the peripheral heel chamber; the inflation pressure of gas retained in the peripheral heel chamber is greater than an inflation pressure of gas retained in the central heel chamber; and the inflation pressure of gas retained in the central heel chamber is greater than an inflation pressure of gas retained in the forefoot medial chamber.

Clause 11: The sole structure of Clause 3, wherein: the bladder system includes multiple stacked polymeric sheets including: a first sheet at least partially defining the foot-facing surface, a second sheet bonded to the first sheet, the first sealed chamber enclosed by the first sheet and the second sheet, a third sheet bonded to the second sheet, and a fourth sheet bonded to the third sheet and at least partially defining the ground-facing surface; and wherein at least one of the multiple discreet chambers is enclosed by the second sheet and the third sheet, and at least one of the multiple discreet chambers is enclosed by the third sheet and the fourth sheet.

Clause 12: The sole structure of Clause 3, wherein: the bladder system comprises domed pods extending at the ground-facing surface; and at least one of the multiple discreet chambers includes multiple fluidly-connected sub-chambers, the fluidly-connected sub-chambers corresponding with the domed pods.

Clause 13: The sole structure of Clause 12, wherein at least one of the multiple discreet chambers includes an annular ring portion that is fluidly isolated from and surrounds one of the sub-chambers corresponding with the domed pods.

Clause 14: The sole structure of Clause 13, wherein the annular ring portion is at a lateral side of the forefoot region.

Clause 15: The sole structure of Clause 3, wherein the multiple discreet chambers include a peripheral heel chamber having: an arcuate portion disposed at a rear of the heel region, a lateral arm portion extending forward from the arcuate portion along a lateral side of the bladder system in the heel region, and a medial arm portion extending forward from the arcuate portion along a medial side of the bladder system in the heel region, the medial arm portion spaced apart from the lateral arm portion.

Clause 16: The sole structure of Clause 15, wherein the multiple discreet chambers include a central heel chamber disposed between the medial arm portion and the lateral arm portion of the peripheral heel chamber, and forward of the arcuate portion of the peripheral heel chamber.

Clause 17: The sole structure of Clause 16, wherein: the bladder system comprises domed pods extending at the ground-facing surface; and the central heel chamber includes multiple fluidly-connected sub-chambers corresponding with multiple ones of the domed pods disposed in a longitudinally-extending row between the lateral arm portion and the medial arm portion.

Clause 18: The sole structure of Clause 3, wherein: the multiple discreet chambers include a peripheral lateral chamber extending along a lateral side of the bladder system in the forefoot region; the peripheral lateral chamber is disposed entirely between a longitudinal midline of the bladder system and the lateral side of the bladder system; the bladder system comprises domed pods extending at the ground-facing surface; and the peripheral lateral chamber includes multiple fluidly-connected sub-chambers corresponding with multiple ones of the domed pods disposed in a longitudinally-extending row along a lateral side of the ground-facing surface in the forefoot region.

Clause 19: The sole structure of Clause 18, wherein the multiple discreet chambers include a medial forefoot chamber disposed along a medial side of the bladder system in the forefoot region and extending over the longitudinal midline.

Clause 20: The sole structure of any of Clauses 18-19, wherein one of the multiple discreet chambers includes an annular ring portion that is fluidly isolated from and surrounds one of the sub-chambers of the peripheral lateral chamber.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:

a midsole including a bladder system having a forefoot region, a midfoot region, and a heel region, wherein the bladder system defines:

a first sealed chamber retaining fluid as a first cushioning layer; and discreet chambers retaining fluid in isolation from one another, each of the discreet chambers disposed at one side of the first sealed chamber, and fluidly isolated from the first sealed chamber;

wherein:

the bladder system defines a foot-facing surface and a ground-facing surface;

the first sealed chamber is disposed between the foot-facing surface and the discreet chambers;

the first sealed chamber extends over the forefoot region, the midfoot region, and the heel region;

the discreet chambers are disposed between the ground-facing surface and the first sealed chamber;

the bladder system comprises domed pods extending at the ground-facing surface;

at least one of the discreet chambers includes fluidly-connected sub-chambers, the sub-chambers corresponding with the domed pods; and one of the discreet chambers includes an annular ring portion that is fluidly isolated from and surrounds only one of the sub-chambers of the one of the discreet chambers.

2. The sole structure of claim 1, wherein none of the discreet chambers extend in each of the forefoot region, the midfoot region, and the heel region.

3. The sole structure of claim 1, wherein the discreet chambers include a peripheral heel chamber in the heel region, a central heel chamber in the heel region, a peripheral lateral chamber in the forefoot region, and a medial forefoot chamber in the forefoot region.

4. The sole structure of claim 1, wherein the discreet chambers include a peripheral heel chamber having:

an arcuate portion disposed at a rear of the heel region, a lateral arm portion extending forward from the arcuate portion along a lateral side of the bladder system in the heel region, and a medial arm portion extending forward from the arcuate portion along a medial side of the bladder system in the heel region, the medial arm portion spaced apart from the lateral arm portion.

5. The sole structure of claim 4, wherein the discreet chambers include a central heel chamber disposed between the medial arm portion and the lateral arm portion of the peripheral heel chamber, and forward of the arcuate portion of the peripheral heel chamber.

6. The sole structure of claim 5, wherein the domed pods are disposed in a longitudinally-extending row between the lateral arm portion and the medial arm portion.

7. The sole structure of claim 1, wherein:

the discreet chambers include a peripheral lateral chamber extending along a lateral side of the bladder system in the forefoot region and is disposed entirely between a longitudinal midline of the bladder system and the lateral side of the bladder system; and the peripheral lateral chamber includes the sub-chambers corresponding with multiple ones of the domed pods disposed in a longitudinally-extending row along the lateral side in the forefoot region.

8. The sole structure of claim 7, wherein the discreet chambers include a medial forefoot chamber disposed along a medial side of the bladder system in the forefoot region and extending over the longitudinal midline.

9. The sole structure of claim 7, wherein the one of the discreet chambers that includes the annular ring portion is the peripheral lateral chamber.

10. The sole structure of claim 1, wherein the annular ring portion is at a lateral side of the forefoot region.

11. The sole structure of claim 1, wherein:

the bladder system includes multiple stacked polymeric sheets including:

an upper sheet at least partially defining the foot-facing surface, a lower sheet at least partially defining the ground-facing surface, and a middle sheet disposed between the upper sheet and the lower sheet; and the first sealed chamber is enclosed by the upper sheet and the middle sheet.

12. The sole structure of claim 11, wherein the multiple stacked polymeric sheets are bonded together at a peripheral flange.

13. The sole structure of claim 12, wherein the upper sheet is bonded to the middle sheet at a plurality of dot bonds spaced apart from one another, the first sealed chamber surrounds a perimeter of each of the dot bonds, and the foot-facing surface has a plurality of dimples at the plurality of dot bonds.

14. The sole structure of claim 1, wherein the discreet chambers have a greater overall height than the first sealed chamber.

15. The sole structure of claim 1, wherein the foot-facing surface is not symmetrical with the ground-facing surface across a horizontal plane extending through the bladder system between the foot-facing surface and the ground-facing surface.

* * * * *